United States Patent [19]

Hoenle

[11] Patent Number: 4,646,497

[45] Date of Patent: Mar. 3, 1987

[54] PANEL COUPLING

[76] Inventor: Egon R. Hoenle, R.R. 1, Box 518-C, Sawyer, Mich. 49125

[21] Appl. No.: 714,573

[22] Filed: Mar. 21, 1985

[51] Int. Cl.[4] ..... E04C 1/10

[52] U.S. Cl. ..... 52/285; 52/286; 52/582; 24/573; 24/574; 403/340; 403/407.1

[58] Field of Search ..... 248/551, 553; 24/573, 24/574; 403/339, 340, 407.1; 52/285, 286, 582, 506, 510, 511

[56] References Cited

U.S. PATENT DOCUMENTS

| | | | |
|---|---|---|---|
| 994,768 | 6/1911 | McAuliffe | 52/285 |
| 1,537,459 | 5/1925 | Campbell | 403/407.1 |
| 2,565,065 | 8/1951 | Chakeres | 403/407.1 |
| 2,980,478 | 4/1961 | Woehrle | 24/573 |
| 3,037,593 | 6/1962 | Webster | 52/476 |
| 3,589,755 | 6/1971 | King | 52/584 |
| 3,676,969 | 7/1972 | Moore | 52/233 |
| 3,819,198 | 6/1974 | Groves | 403/339 |
| 4,025,216 | 5/1977 | Hives | 403/381 |
| 4,160,609 | 7/1979 | Jackson et al. | 403/340 |
| 4,545,168 | 10/1985 | Dalton, Jr. | 52/36 |
| 4,565,465 | 1/1986 | Oberst | 403/407.1 |

*Primary Examiner*—John E. Murtagh
*Assistant Examiner*—Andrew Joseph Rudy
*Attorney, Agent, or Firm*—Paul H. Gallagher

[57] ABSTRACT

A coupling unit includes a pair of parts, mounted on respective panels, each on an axis extending through the panel. The panels are moved into coupling position, with the parts thereby in interconnecting position, with elements of the parts interlocking, and their axes coincident. The two parts are then rotated on their common axis. Two units are used together, in spaced apart relation. In one form of the device, the parts of each unit are identical, and in another form, they are respectively of male and female shapes.

22 Claims, 18 Drawing Figures

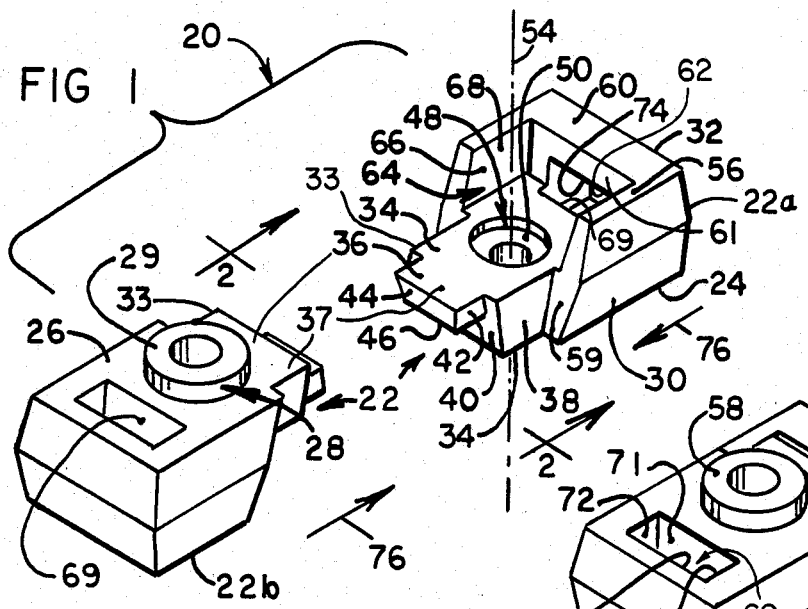
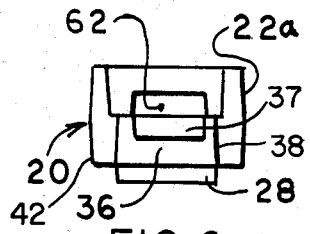
FIG 2
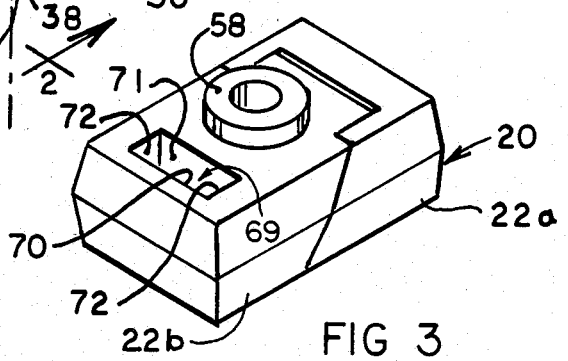
FIG 3
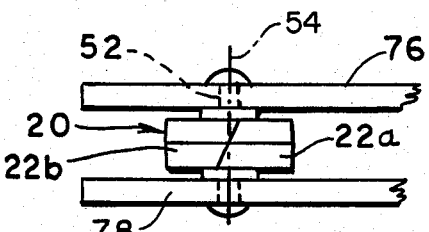
FIG 4
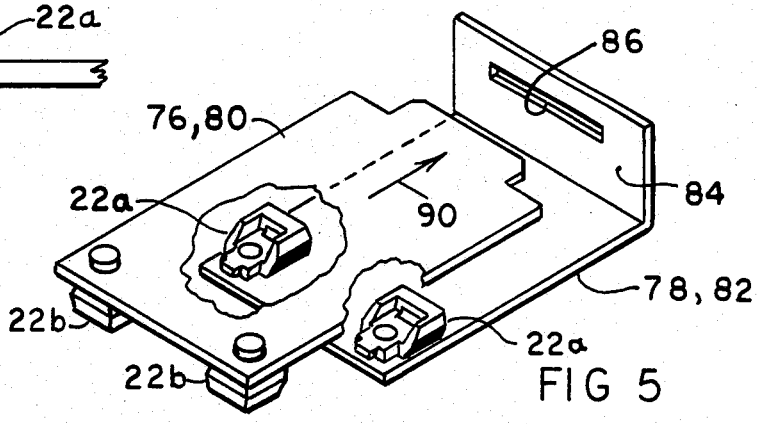
FIG 5
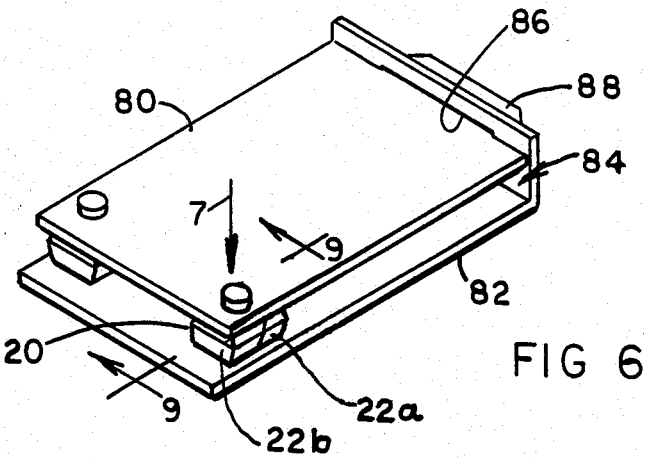
FIG 6

PANEL COUPLING

FIELD OF THE INVENTION

The invention resides in the field of couplings for coupling together panels or equivalents, such as pieces of equipment, or articles, or temporarily locking them together, in assembled position, in such a way that they can be uncoupled, and separated, and again coupled together, without adversely affecting the coupling means, and the coupling means can be so used repeatedly indefinitely.

OBJECTS OF THE INVENTION

A broad object of the invention is to provide novel coupling means for temporarily coupling pieces or members together in a temporary or releasable manner, and enabling them to be again coupled together, with the same coupling means, repeatedly indefinitely, and particularly such coupling means having the following features and advantages.

1. It is of extremely simple nature, and inexpensive both in materials used and steps of fabrication.

2. It is easy to manipulate, both in coupling and uncoupling steps.

3. It can be utilized in places that are hard to get at normally, but when used in such places, is easily accessible, and easy to manipulate.

4. It is of such character that it can be made of any of a wide range of sizes, for use with members to be coupled, that are of a corresponding range of sizes.

5. It is made up of a pair of parts which in one form of the device are identical in construction, and because of that identity, the parts can be used interchangeably, with consequent simplicity and facility in manufacture and utilization.

DESCRIPTION OF CERTAIN PREFERRED FORMS OF THE INVENTION

In the drawings,

FIG. 1 is an isometric view of the two parts, in this case identical, making up the coupling.

FIG. 2 is an end view of one of the parts, taken at line 2—2 of FIG. 1.

FIG. 3 is an isometric view of the parts of the coupling of FIG. 1, shown in assembled position.

FIG. 4 is a side view of a coupling, from the near side of FIG. 3, between a pair of panels coupled together.

FIG. 5 is an isometric view of a pair of panels to be connected, shown in a step just before the final coupling step.

FIG. 6 is a view similar to FIG. 5 but showing the panels in assembled and coupled position.

Figure 7:
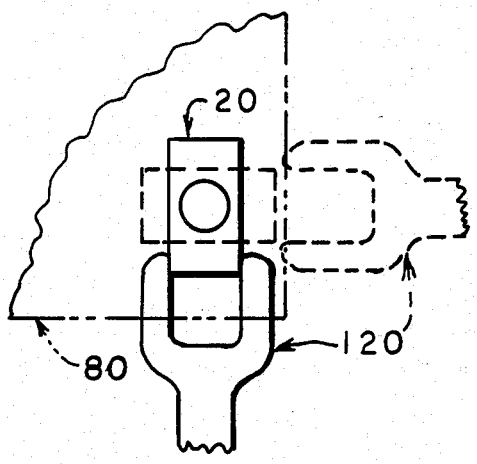
FIG. 7 is a face view looking down, of the near corner of FIG. 6, as indicated by the arrow 7.

Referring in detail to the accompanying drawings attention is directed first to FIGS. 1–3 showing the complete coupling, isolated from its association with the panels. As used herein, panel is generically to include any articles to be coupled together.

The coupling is indicated in its entirety at 20, and is made up of two parts or counterparts 22 which in the present instance are identical, and individually identified *22a, 22b*. The two parts 22 assume a relation to each other, in coupled relation, corresponding to one of the parts being rotated 180° about a transverse axis.

The coupling, and each of its parts, is made of any suitable material, depending on the size and strength desired, They may be made of plastic for example or steel, and are formed and shaped according to known techniques. In the case of plastics, they may be molded, and in the case of steel they may be cast, forged, or formed by other known process.

The following description of the detail construction of each of the parts, is based on predetermined orientation, for the sake of convenience, and as related to the movements of the parts together in the coupling and uncoupling actions.

Each of the parts is integral, and may be compared to a block, having a bottom wall 24 with a main under surface 26 from which extends a circular boss 28. The part includes sidewalls 30 and a rear wall 32. The side walls are positioned at the rear of the part, forming a forward projection 33 of the bottom wall 24. The bottom wall has an upper surface 34 and from the forward end of the bottom wall 24 extends a tongue 36 having an upper surface 37 flush with the upper surface 34. The bottom wall 24 has side surfaces 38 and a front end surface 40 which is of "C" shape so formed by the tongue 36. The tongue has side edge surfaces 42, a front end surface 44 and an under surface 46. The bottom wall 24 is provided with a hole 48, in the present instance having a counterbore 50. This hole passes through the bottom wall for reception of securing means, such as a bolt, screw, etc., indicated diagrammatically at 52 in FIG. 4, for mounting the coupling part on the panel. The securing means may take any of various forms as will be referred to again hereinbelow. The hole 48 is formed on a vertical axis 54 and when the two parts are in coupled or assembled position, the axes 54 of the two holes coincide in a common axis, as will be referred to again hereinbelow.

The side walls 30 extend from the under surface 26 of the part, and terminate in a top surface 56 which lies in a common plane with the bottom surface of the counterpart as shown in FIG. 3, and as will be referred to again hereinbelow. The hole 48 is formed through the boss 28, forming an anular shape of the latter, now identified 58. The side walls 30 have front surfaces 59 extending the full height, or depth, of the part and of planar shape throughout that full dimension, and inclined upwardly and rearwardly. The rear wall 32 has an upper element or ledge 60 extending forwardly, having a front edge surface 61 forming a slot 62 below it and above the top surface 34.

The side walls 30 together with the ledge 60 and the bottom wall 24 form a recess indicated generally at 64 opening to the front at 66 and upwardly at 68.

A cavity 69 is formed through the bottom wall 24, extending upwardly and opening into the slot 62, this cavity having a rear surface 70 (FIG. 3), a front surface 71, side surfaces 72 and a top surface 74.

The various surfaces of the elements of the part, referred to above are inclined for the most part, rather than being mutually perpendicularly arranged, to facilitate fabrication thereof such as by molding or casting, and to provide proper interengagement between corresponding elements of the counterparts. For example, the side surfaces 38 taper inwardly in upward direction (FIG. 2), while the side surfaces 42 of the tongue 36 taper inwardly in downward direction. These counter-inclined surfaces provide the desired interfitting of surfaces as between the two parts when the parts are assembled as shown in FIG. 3 where, as indicated above, the two parts are in oppositely disposed position.

In the use of the coupling, the two parts are relatively disposed first as shown in FIG. 1, as indicated above, and in the specific coupling operation, the two parts are moved toward each other as indicated by the arrows 76, and in this step, the forward projection 33 of one of the parts moves into the cavity 64 of the other part, and in this same step, the tongue 36 of one part moves into the slot 62 of the other part. In this movement, they assume a final position in which the axes 54 are coincident in a common axis, and the two parts so assembled, and thus the coupling as a whole, can be rotated about that axis, as referred to again hereinbelow. The parts are designed and dimensioned and proportioned such that they have interengaging surfaces that determine their movement together to the extent mentioned, i.e., with the axes 54 in coincidence. They may be determined specifically by any of the various surfaces, concerned, such as the inclined surfaces 59, or the surfaces 40, 61, or the surfaces 44, 70. In this assembled position the tongues 36, being in the slots 62, prevent separation of the parts in direction along the axis 54. Thus each of the parts may be compared to a cube having five walls and one open side. One part enters into the open side of the other, and each is prevented from movement relative to the other in each of the other five directions.

FIG. 4 shows a pair of panels 76, 78 to which the parts of the coupling are respectively secured. The securing means 52 may be a bolt or a screw, fitted in the hole 48 and secured in the panel, enabling free rotation of the part about the axis. The parts are so mounted with the annular bosses 28 fitted against the panels and serving as bearing surfaces therebetween, and in such position the recesses 64, through their open top sides 68 are directed away from the panels.

The panels 76, 78 may be of any desired kind, and a particular installation of the coupling is represented in FIG. 5 and 6. In these figures one of the panels may be a P.C. board 80 and a chassis 82, of known kind. The chassis 82 has a flat main part, and an upturned flange 84 at one end provided with a slot 86, while the P.C. board 80 has a tongue 88 at one end. A pair of couplings 20 are utilized, in spaced apart position. The parts **22*a*, 22*b* of each coupling are mounted on the chassis 82 and P.C. board 80 respectively. In the mounting of the panels, the coupling parts are positioned with the open front sides 66 of the recesses directed toward each other and the panels moved together as indicated by the arrow 90, in FIG. 5. This moves the coupling parts into assembled position as represented in FIGS. 1 and 3 and described above. After they are moved into such position, and with the axes 54 coincident, a wrench 92 (FIG. 7**) is applied to at least one of the couplings, and that coupling as a whole, i.e., the two parts together, is rotated to a new position. This new position is not critical, and theoretically as long as one of the couplings is moved out of the initial parallel relation with the other, the panels are coupled or locked.

Figure 8:
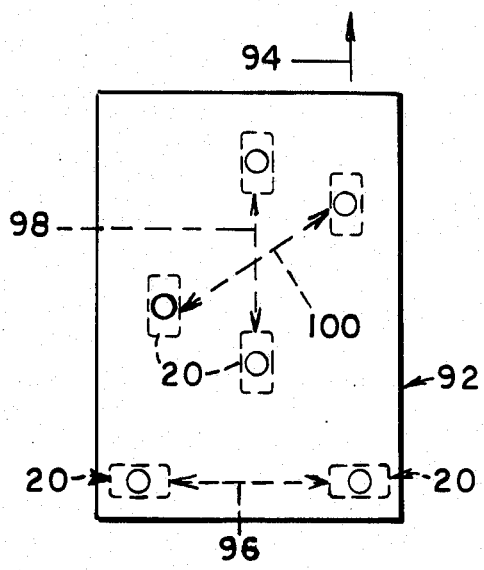
FIG. 8 is a semi-diagrammatic view, of the face of a panel to be coupled to another panel, oriented as if looking down on FIG. 6.

The two couplings in any given installation, may assume any of virtually unlimied positions, so long as they are spaced apart from each other. This situation is represented in FIG. 8 which includes a panel 92 representing a pair of panels, in which the relative movement between the panels in the coupling step is represented by the arrow 94. The couplings 20 may be spaced apart transversely as indicated by the line 96 relative to the direction of movement, arrow 94, or longitudinally as indicated by the line 98 or diagonally as indicated by the line 100. In the case of any such spacings, so long as the coupling of a pair are in different relative positions, about their axes 54, the panels are locked.

Figure 9:
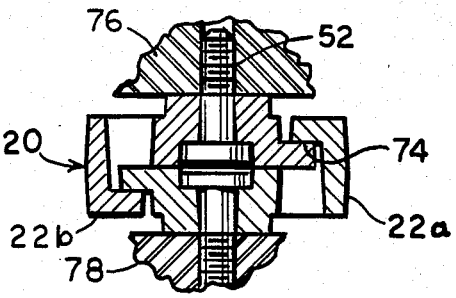
FIG. 9 is a sectional view taken at line 9—9 of FIG. 6.

FIG. 9 shows the parts of the coupling when interengaged, showing the engagement between various ones of the counterpart surfaces on the two parts. As represented in this figure, the securing means 52 (FIG. 4) may be threaded bolts extending into or through the panels 76, 78.

Figure 10:
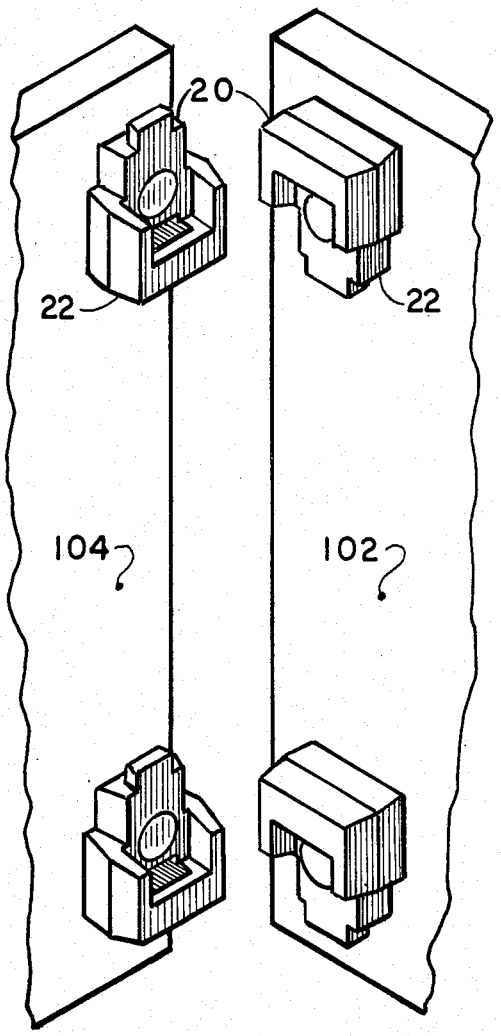
FIG. 10 is a fragmentary isometric view of a pair of panels to be coupled together.

As indicated above, the coupling may be of any desired size and strength. In the case of a P.C. board and mounting panel (FIG. 6), the coupling may be very small, such for example as approximately $\frac{7}{8}'' \times \frac{1}{2}'' \times \frac{3}{8}''$, but couplings of much larger size would be used, for example, in walls and large construction, represented in FIG. 10. The latter figure shows a pair of panels 102, 104 on which the coupling parts 22, these panels being walls or members or pieces of equipment of any size. In this case, the coupling parts 22 are secured on the flat surfaces of the panels, and the two panels coupled together by placing the panels in face-to-face relation.

Figure 11:
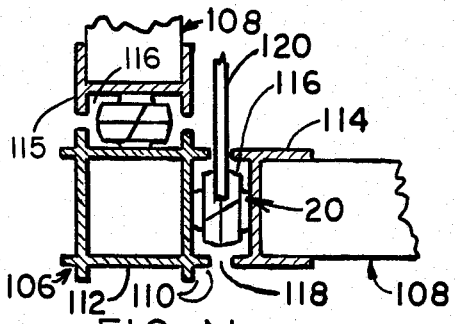
FIG. 11 is a top view showing panels connected to a post.

The coupling is not limited to the coupling together of flat panels, but may be utilized in connection with other forms of elements. For example, FIG. 11 shows a post 106 utilized for mounting panels 108. In this case one of the coupling parts is mounted on the post, and the other mounted on the edge surface of the panel, i.e., it is not limited to positioning on the flat surface thereof. In many cases the space between such panels and post is limited, or cramped and very difficult to apply ordinary couplings thereto. An example of such cramped space is that posts of the kind indicated at 106 may have beads 110 forming recesses 112 therebetween. The panel may also have side elements 114 forming similar beads 115 with a space 116 therebetween. The coupling parts 22 are mounted to the respective post/panel, in the spaces 112, 116, and notwithstanding the small space, 118, between the corresponding beads 110, 115, a wrench 120 of very thin dimensions may be utilized and inserted through the space 118.

Figure 12:
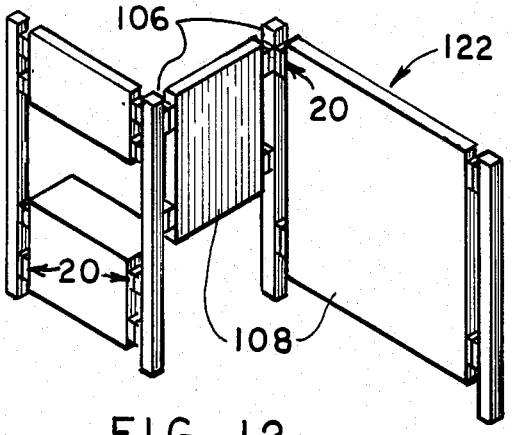
FIG. 12 is an isometric view of a room divider made up of panels and posts of the kind shown in FIG. 11.

The construction of FIG. 11 may be utilized to great effect as a room divider, for example, as represented at 122 in FIG. 12. In this case the panels 108 may be mounted to an intermediate post 106 on adjacent sides of the latter, and in corresponding positions on different posts, for forming an angular or zig-zag shape of the divider. This space divider may be set up and knocked down very conveniently.

Figure 13:
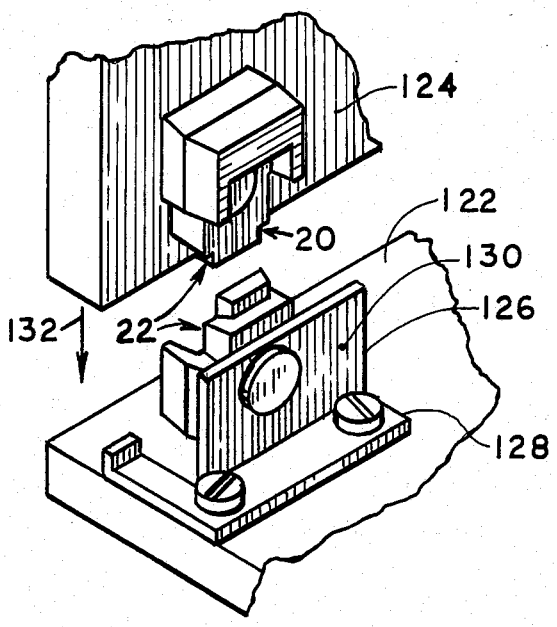
FIG. 13 is a fragmentary isometric view of a pair of panels, in mutually spaced position, to be coupled in perpendicular relation.
Figure 14:
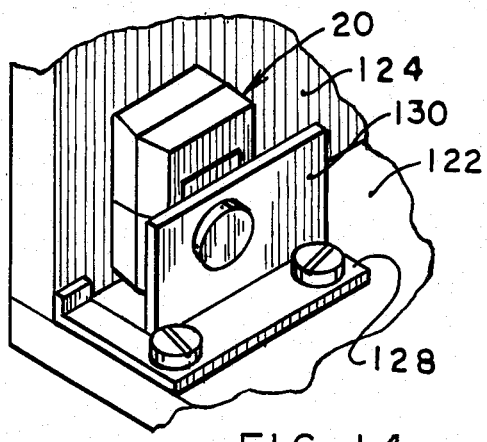
FIG. 14 is a view similar to FIG. 13 but with the panels in assembled and coupled position.

The coupling is also adaptable to mounting panels in a mutually perpendicular position, as represented in FIGS. 13, 14, where two panels 122, 124 are perpendicularly disposed. The coupling 20 is shown, with the two parts 22 thereof, one mounted on the broad surface of the panel 124 and the other on a bracket 126 which itself is mounted on the panel 122. The bracket 126 has a base portion 128 fitted flat to the broad side of the panel 122 and an upstanding flange 130 to which the coupling part 22 is mounted. In FIG. 13 the panels are spaced apart, and in the coupling movement, the panel 124 is moved downwardly as indicated by the arrow 132 into coupling position shown in FIG. 14, in which the coupling parts are interengaged. The construction of FIGS. 13, 14, in the coupling step, thus utilizes movement along a line extending longitudinally of the coupling parts. When panels or corresponding parts are coupled or interconnected in face-to-face relation, the line of movement is along the faces of the panels, but in the present case, the arrangement, including one of the coupling parts on the bracket 126, enables movement of the panels along the line parallel with one of the panels and perpendicular to the other. In this construction, the bracket 126 may be considered as a part of the corresponding coupling part.

Figure 15:
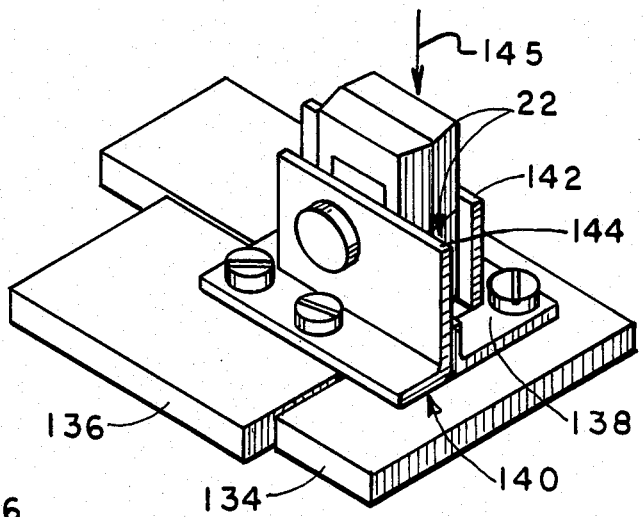
FIG. 15 is an isometric view of a pair of panels in assembled and coupled position, with the panels lying in a common plane.

In FIG. 15, the panels, 134, 136, lie in a common plane, each provided with a bracket, 138, 140, and the brackets having flanges 142, 144 extending perpendicular to the panels. The coupling parts 22 are mounted on the respective flanges 142, 144. The arrangement of FIG. 15 is to accommodate panels which for example are arranged with one entirely inside another, and thus cannot be moved relatively in the plane mentioned, but must be moved perpendicularly thereto, in assembling and disassembling them. This movement is accommodated by the flanges 142, 144 on which the coupling parts 22 are mounted, and the line of movement between the coupling parts is parallel to the surfaces of the flanges, as indicated by the arrow 145.

Figure 16:
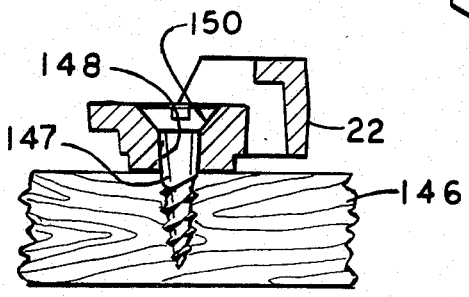
FIG. 16 is a sectional view of one of the parts of the coupling secured to a panel, and showing a different form of means securing the part to the panel.

FIG. 16 shows the capability of use of the device with another kind of securing means, and/or panel. Instead of a bolt such as 52 (FIG. 9) a wood screw 147 may be utilized for turning into a panel 146 made of wood for example. In the coupling part 22, the hole 148 is shaped and dimensioned for receiving the wood screw, having for example a chamfer 150 for receiving the tapered head of the screw.

Figure 17:
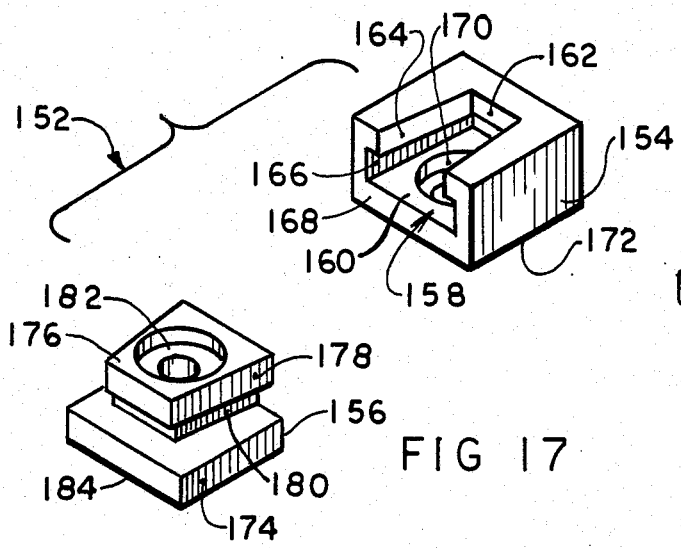
FIG. 17 is an isometric view, similar to FIG. 1, showing a modified form of coupling.
Figure 18:
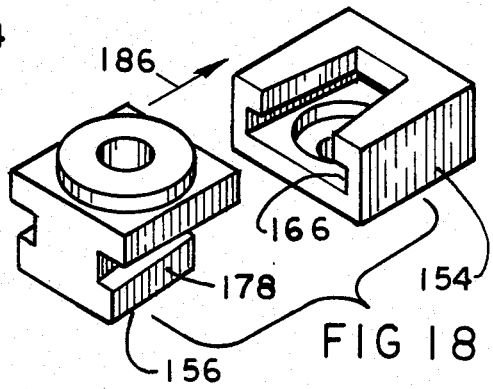
FIG. 18 is an isometric view showing the parts of FIG. 17, but with one of them inverted relative to FIG. 17 and in position to be moved together in coupling relation.

FIGS. 17 and 18 show a modified form of coupling, in which the parts are not identical. In this case the coupling as a whole is indicated at 152 and includes parts 154, 156. The part 154 includes a recess 158 opening forwardly as indicated at 160 and upwardly as indicated at 162. The recess has, on three sides, a bead or ledge 164 under which is a groove 166 on the three sides. The part 154 includes a bottom wall 168 through which is formed a hole 170 for receiving the bolt or screw for mounting the part on the panel, in which the under surface, indicated at 172 is fitted to the panel.

The part 156 includes a main element 174 and an embossment or male element 176 which fits into the recess 158. This element 176 includes a bead 178 on three sides under which is a groove 180 also on three sides, and a hole 182 for receiving the mounting element. The element 174 has a surface 184 which is fitted against the panel on which it is mounted.

In the use of the coupling of FIGS. 17, 18, the parts are moved to relatively opposite position as represented in FIG. 18, and moved toward each other as indicated by the arrow 186 with the projection or male element 176 moved into the recess 158.

In the present instance the interengaging surfaces, i.e., those of the recess and the male element are of tapered form which facilitates fitting of the parts together, these surfaces producing a camming effect and overcoming any slight misalignment between the parts. As will of course be understood the bead 176 in the part 156 engages into the groove 166, and prevents movement in direction perpendicularly of the parts.

A coupling 20, made up of two parts, will also be referred to here at times as a coupling unit, for convenience.

I claim:

1. Coupling means for connecting a pair of panels together, wherein, the panels are movable from a mutually relatively spaced and separated position along a predetermined first line into an interlocking position, the coupling means including a pair of coupling units each being made up of a pair of parts and each having a part on each of the panels, the parts on each panel being in spaced apart relation and at equivalent spacing on both panels, the parts of the coupling units being movable relative to the panels about mutually parallel axes disposed at an angle to said line of movement, and being settable to predetermined first positions relative to each other whereby the related parts of each coupling unit are moved into interlocking relation in response to movement of the panels into their said interlocking position, the parts of each coupling unit being separable along a return line in direction opposite said first line, and being interlocked against movement in any other direction, the parts of each coupling unit being together movable about their respective axis, and the unit is thereby correspondingly movable about that axis, relative to and independently of the panels, whereby in response to at least one of the units being so moved about its said axis, the parts cannot be moved apart along said return line, whereby the panels are interlocked in response to the condition wherein not all the coupling units are in such position where the respective parts can be moved along said return line.

2. Coupling means according to claim 1 wherein, the line of movement along which the panels are moved follows the surfaces of the panels on which the parts are mounted.

3. Coupling means according to claim 1 wherein, the axes of the parts are substantially perpendicular to said line of movement.

4. Coupling means according to claim 1 wherein, each unit is movable bodily, when the parts thereof are in such coupled position, in direction in which the elements of the parts thereof move transverse to said predetermined line.

5. Coupling means according to claim 1 wherein, the units are spaced apart in direction independent of the direction of said predetermined line.

6. Coupling means according to claim 1 wherein, the parts are positioned with their axes of rotation substantially perpendicular to the surfaces of the panels on which they are mounted.

7. Coupling means according to claim 1 wherein, the panels when coupled are disposed in other than parallel position, on one of the panels the corresponding parts of the units are mounted on a broad surface of the panel, and on the other panel, means is provided mounting the corresponding parts of the units on a surface other than the broad surface of that panel, whereby said predetermined line of movement extends parallel with one of the panels but other than parallel with the other panel.

8. Coupling means according to claim 7 wherein, the panels when coupled assume a substantially perpendicular position.

9. Coupling means according to claim 1 wherein, the panels when coupled are disposed in other than parallel and spaced position, on each of the panels means is provided for mounting the corresponding parts of the units on a mounting surface other than the broad surface thereof.

10. Coupling means according to claim 9 wherein, the panels when coupled, assume such position that said mounting surfaces are parallel, and said predetermined line extends parallel with said mounting surfaces.

11. Coupling means according to claim 10 wherein, the panels, when coupled, lie in a common plane.

12. Coupling means according to claim 10 wherein, one of the parts includes essentially a hollow cube having an open side directed transverely from its said axis, and the other five sides closed, the other part having a positive element extending transfersely from its said axis, the parts being relatively movable along said predetermined line which extends transversely between their said axis, thereby enabling the positive element to enter the hollow cube, into their said interconnecting position, and the parts when so coupled, being relatively immovable in any of the directions corresponding to said five sides, but being relatively movable only along said predetermined line in direction opposite the coupling movement.

13. Coupling means for coupling a pair of panels together, comprising, a pair of coupling units each including a first and a second part, the coupling units being mounted on the panels in spaced apart relation in an arrangement in which each part of each coupling unit is mounted on a respective one of the panels for rotation, an axes of rotation of the parts being substantially parallel in the steps of coupling the panels together, the parts of each coupling unit being movable to an interconnecting position in only one direction along a predetermined line transverse to said axes, and when in such position their axes lie in and form a common axis, and being disconnectable by relative movement only in the direction opposite said one direction, each part of each coupling unit being pre-positionable about its own axis to position the parts for enabling movement of the respective parts into said position in response to movement of the panels in said one direction, and when the respective parts are in their connecting position, each coupling unit, constituted by a pair of connected parts, being rotatable about its own said common axis to a locking attitude, preventing relative movement of the panels in said opposite direction for disconnecting the parts of the units.

14. A coupling unit for use in connecting a pair of panels together, comprising, a pair of parts adapted for mountlng on respective panels, and adapted to be coupled when so mounted, and each having an under side engaging the panel when so mounted, and an upper side, each part including means for mounting it on the panel for rotation on an axis extending through the panel, one of the parts having a recess in its upper side and the other having a projection on its upper side, the two parts being movable toward each other in a coupling direction along a line transverse to each said axis to a coupling position in which said axes of the parts coincide in a common axis, and the parts when in said coupling position being separable only in direction opposite said coupling direction.

15. Coupling means according to claim 14 wherein, the parts are identical,

16. Coupling means according to claim 15, wherein each part has a recess and a projection, and the recess and projection on each part are mutually spaced apart in direction both transverse to the axis of the part and along that axis.

17. Coupling means according to claim 16 wherein, each part has a lower portion forming a large portion of the part, constituting the element engaging the panel, and including said projection which extends in a forward direction relative to the part, and in each part, the recess is disposed adjacent the upper side of the part, and adjacent the rear side of the part.

18. Coupling means according to claim 17 wherein, each part includes a rear wall containing a slot forming a rearward extension of the recess, each projection including a forwardly extending tongue positionable in the slot of the other part, side walls extending the full axial dimension of the part and extending forwardly from the rear wall a portion of the length of the part, and the side walls having forwardly directed surfaces which interface in the two parts.

19. Coupling means according to claim 18 wherein, each part includes a main integral body portion and has a hole through the lower portion, and includes bolt means positioned in the hole and secured to the panel for mounting the part of the panel, and enabling rotation of the body portion about the bolt means about its said axis.

20. Coupling means according to claim 18 wherein, the parts define a parting line therebetween, and the respective elements of the parts on opposite sides of the elements of the parting line, are mutually closely adjacent and continue in a straight surface across the parting line.

21. Coupling means according to claim 14 wherein, the parts are non-identical.

22. Coupling means according to claim 21 wherein, the recess and projection have interengaging inclined elements lying essentially in a plane disposed transversely of said axes, providing camming action in moving the parts into coupling position.

* * * * *